United States Patent [19]

Torrance

[11] 4,227,302

[45] Oct. 14, 1980

[54] SHAVING APPARATUS

[76] Inventor: William L. Torrance, 5 Lamont Ave., Agincourt, Canada

[21] Appl. No.: 1,366

[22] Filed: Jan. 5, 1979

[51] Int. Cl.[3] ..... B26B 21/06; B26B 21/54

[52] U.S. Cl. ..... 30/47; 30/87

[58] Field of Search ..... 30/47, 50, 85, 87

[56] References Cited

U.S. PATENT DOCUMENTS

| | | | |
|---|---|---|---|
| 2,603,860 | 7/1952 | De Swart | 30/47 |
| 3,080,651 | 3/1963 | La Cas | 30/85 X |
| 3,340,609 | 9/1967 | Sacharow | 30/85 |
| 3,950,848 | 4/1976 | Goldstein | 30/47 |
| 3,975,820 | 8/1976 | Torance | 30/47 |
| 4,026,016 | 5/1977 | Nissen | 30/47 |

*Primary Examiner*—Gary L. Smith

*Attorney, Agent, or Firm*—K. Maxwell Hill

[57] ABSTRACT

A razor has a handle which holds a pair of double-edged blades enclosed by a cartridge member, by means of a flexible yoke having cartridge engaging hooks on each of its yoke arms. Dimple bearing means located on each side of the cartridge keep the yoke hooks in engagement with the cartridge. A central rod holding the yoke bears against an upturned end of a razor handle and acts to spread the yoke arms in loading and unloading the cartridge onto the yoke hooks. The rod holds the yoke and cartridge assembly in either a rigid posture or with allowance for a free float of the cartridge on the pivot bearings of the hooks in the dimples by means of a tooth on the rod in ratchet-like engagement with various slots formed in the handle adjacent the path of travel of the push rod to and from contact with the upturned end of the razor body.

3 Claims, 4 Drawing Figures

SHAVING APPARATUS

BACKGROUND OF THE INVENTION

1. Field of the Invention

The present invention relates to razors for the shaving of human hair and more particularly relates to improvements in the handle means employed to hold a shaving blade element or cartridge. The invention includes novel means for picking up and releasing, and reversing a blade cartridge member.

2. Prior Art

It is known in wet shaving apparatus, to retain the disposable blade member between a pair of guard plates that are threadably affixed to a handle. Shaving devices of the above simple type are being continually changed with a view to preventing a shaver from cutting himself. A recent development is the simple enclosing of the blade in a disposable cartridge to eliminate the necessity of the shaver having to touch the blade. A further improvement is the provision of loading and ejector means in the handle to prevent the user from even the chance or need to touch the cartridge itself.

The most recent development in safety razors includes a cam means in the handle assembly to create a biasing force against the blade cartridge or vice-versa in the expectation that the blade cartridge will follow the contour of the surface being shaved. The disadvantage of the latter development is the large number of oddly shaped parts which require manufacture and assembly together to make the moveable part.

Simultaneous with the latter moveable shaving cartridge is the development and marketing of completely disposable shaving assemblies i.e. handle and cartridge and all. The disadvantage of the disposable shavers is that they use a pair of single edged blades only rather than double edged blades.

SUMMARY OF THE INVENTION

The object of the present invention is to provide a razor for wet shaving facial hair and the like, comprising a blade holding cartridge having pairs of cutting edges on either side of parallel sides of the cartridge thereby to give double working life to the cartridge, and wherein the cartridge holding handle means has a spring yoke member disposed to hold the cartridge in moveable relation therewith whereby the cartridge can be picked up, reversed and released by actuation of a push rod member connected with the yoke and actuated by pressure of an operators finger on a knob provided on the end of the push rod where it protrudes from an aperature in the handle.

THE DRAWINGS

The above objects are shown in the accompanying drawings of preferred embodiment of the invention where like reference numerals refer to like parts throughout the several viewsdiscussed below.

THE PREFERRED EMBODIMENT OF THE INVENTION AND MODE OF OPERATION

Figure 1:
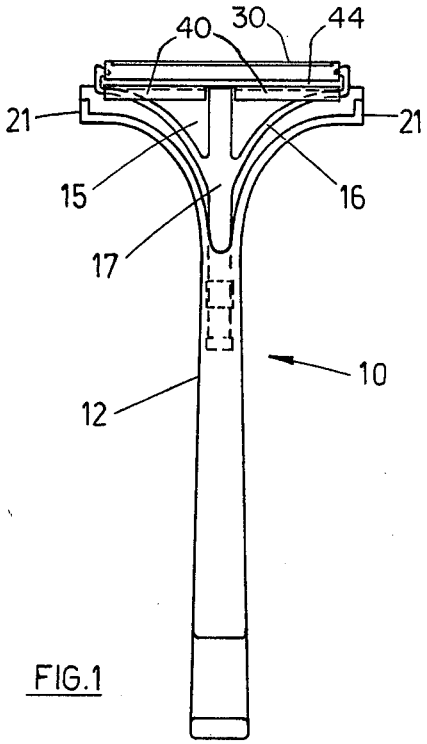
FIG. 1, is a bottom view of the assembly as held in a shavers hand showing the yoke sprung into a cavity in the end of the handle showing the itegrally formed push rod slidable in an aperature in the handle.

The novel razor assembly discussed herein is designated numeral 10 in the drawings and comprises a handle member 12 with a generally upturned end portion 14. The end portion 14 of the handle shown in plan view of FIG. 1 is enlarged or splayed out as indicated to provide a cavity or spoon portion 15 to receive the yoke member 16.

The yoke 16 is integrally preformed together with a push rod 17 and the assembly is fitted into the cavity 15 with the push rod 17 interfitted to the aperture 18 in the handle 12.

Figure 2:
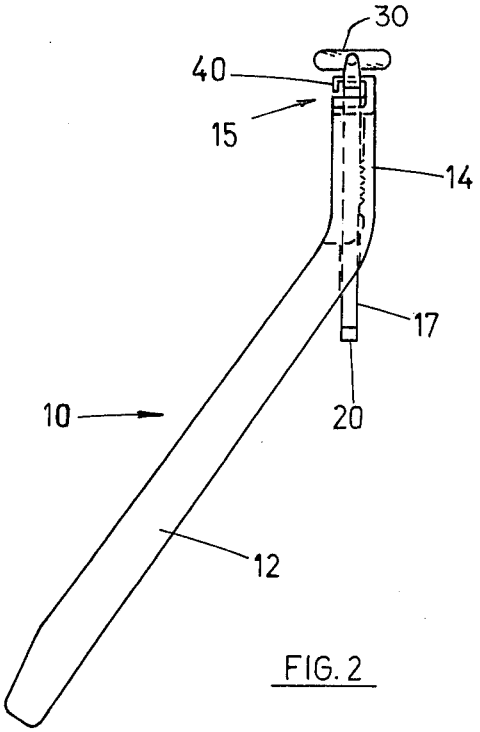
FIG. 2, is a side elevation view of the handle showing a double-edged pair of blades enclosed in a cartridge which is held by the yoke to the handle.
Figure 3:
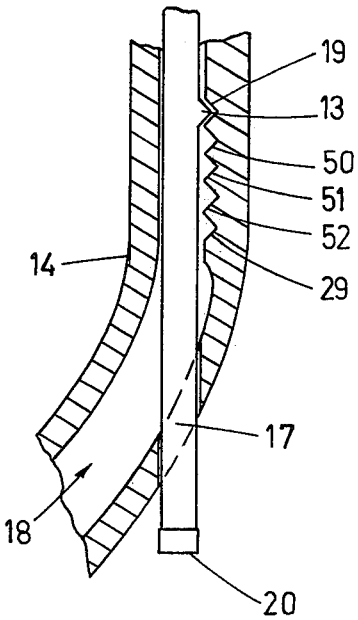
FIG. 3, is an enlarged view of the centre part of the handle proximate the yoke showing the slot or aperature in the handle for receiving the push rod and the tooth and slot or ratcet means of holding the rod in either one of two fixed positions to the handle.

The push rod 17 is held to the handle within aperture 18 adjacent the bend in the handle by means of a tooth 13 on the push rod 17. Tooth 13 co-operates with one of slots 19,50,51,52,29, formed on the inside of the wall of aperture 18 to create a ratchet for tooth 13. A finger engaging knob 20 protrudes from the upper side of the handle 17 as shown in FIG. 2, and allows a shaver to push the tooth 13 into engagement with ratchet slot 19 which forces the yoke up against the handle end plate 44.

Figure 4:
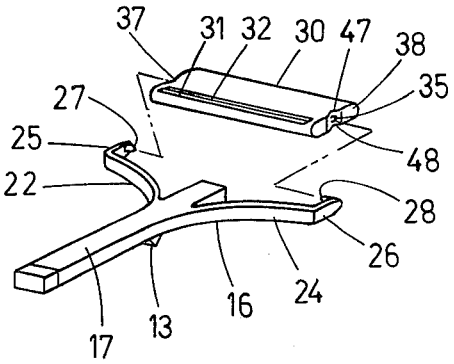
FIG. 4, is a perspective view of the yoke and the push rod with a pair of double edged blades enclosed in a cartridge and shown exploded from the ends of the yokes.

The yoke 16 consists of a pair of springable arms 22,24 each having upward disposed arms end members 25,26. Each of ends 25,26, forms a hook-shaped pivot end 27,28 as shown in FIG. 4. When the yoke is pushed by rod 17, against the end plate 44 of handle cavity 15, the arms 22,24, will spring outwardly to spread the hooks 27,28 apart and thereby release the blade cartridge. The blade cartridge 30 encloses a pair of double edged blades 31,32, in spaced apart relationship and in parallel.

A depression or dimple 35 is formed at the mid point of each end 37,38, of the cartridge 30. The cartridge 30, is moveably attached to the yoke 16 by the pivot action provided by the hooks 27,28 in the dimple bearings 35. In order to assemble the cartridge onto the yoke the handle face end plate 44 is placed over the cartridge allowing hooks 27,28 to come into engagement with the bearings 35, when the tooth 13 of push rod 17 is in the 19 slot. With the hooks 27,28 spaced apart adjacent the bearings 35 of cartridge 30, a gentle push of the handle in the direction of the end face plate 44 against the cartridge while the assembly is held against a firm surface will release the arms 22, 24, and cause the push rod 17 to travel into the aperture 18 and release tooth 13 from slot 29. When the hooks 27,28 seat into the bearings 35 of cartridge 30 the tooth 13 will be seated and held in slot 29 with the cartridge firmly contacting the handle end 44, to provide a firm rigid assembly as in the usual known shaving apparatus.

To prevent the yoke arms 22,24, from popping upwards out of the cavity 15 in the handle 14, when they are sprung outwards by the force of the end plate 44 against the end of push rod 17, a lip 40, divided as shown to admit the rod 17, is formed to partially overlie the yoke arms when engaged by the end 44.

An upwardly standing wall 21 is also formed on the outer edges of the handle cavity 15 to assist in retaining the yokes in engaging relation with the cartridge when it is desired to convert the razor from a rigid assembly to one having a floating cartridge shaving means. In FIG. 1, the cartridge 30 is shown in close contact with the handle end to prevent the cartridge from moving on the pivots 27,28. In FIG. 2 a space will be seen between cartridge 30 and the handle end 14 and is in the free floating mode.

To achieve the free floating mode for the razor, the operator will merely push the knob 20 to cause the tooth 13 to re-seat from slot 29, to slot 51,50, or 52. Only when the rod 17 is pushed to allow tooth 13 to seat in slot 19, will the yokes spread sufficiently to release the cartridge 30, as rod 17 does not strike end 44 until tooth 13 arrives at 19 and beyond towards the forepart of the assembly. The wall 21 acts in the floating position to prevent the ends from disengaging prematurely and causes the forward distortion of the yokes to be contained by their own ability to flex and distort throughout their length. The square cross-section of the yokes can also assist in maintaining a good contact to the end 44 as held by lip 40.

Sharp shoulders 47 48 are provided the dimple 35 where the pins 27,28 of the yoke ends pivot in the cartridge to insure that the rectangular shaped arm ends of the yoke, 25,26, will bind and cause the cartridge to seek a free mid position of free float as shown in FIG. 2.

OPERATION OF THE APPARATUS

To load a blade cartridge into the yoke of the handle the knob 20 of the rod is pushed by the operators finger while he grasps the handle. The force of the manual push on the rod will cause the yoke to splay outwards and allow its ends to interfit over the ends of a cartridge which has been placed on a firm surface facing the yoke. While holding the handle firmly in his hand and after releasing his finger from knob 20, the operator will push the handle against the cartridge and the firm surface, such as a cartridge package, behind the cartridge, and while the yoke ends are aligned adjacent the dimples of the cartridge. The reaction of the firm surface against the end of the handle enclosing the yoke will cause the rod to be pushed out of engagement with tooth 19 and move into the handle to seat in tooth 29, and allow the yoke to spring into end engagement with the cartridge. The razor assembly will now become a fixed blade type of shaving apparatus with tooth 13 holding in tooth 29.

To become a floating head type of shaver the rod can be pushed by the shaver's finger while holding the handle by pressure on knob 20 to seat the tooth 13 in position 50,51, or 52, which allows the cartridge to float on its hooked ends 27,28.

To release the apparatus from the cartridge the knob 20 is pushed inwards to seat the rod tooth 13 in slot 19 which causes the rod and handle end to splay out the yoke and allow the cartridge to be released from the handle's grip.

I claim:

1. A razor assembly comprising in combination:

a handle member having a spoon-like end thereon;

an upturned wall fomed perpendicular to said handle at said end;

a double-edged pair of parallely apart blade members enclosed in a cartridge means exposing the blades for use therefrom and having in said cartridge a pair of oppositely spaced sides adjacent the blade edges;

bearing means situate at the mid-pont of each of said sides;

a Y-shaped spring yoke member adjustably situated within the spoon-like cavity of said handle end;

said Y-shaped yoke comprising two arm members, each having inwardly facing hooks on the ends thereof adapted to mate with the bearings of said cartridge when the yoke arms are sprung outwardly over the cartridge by the pressure of the inside of each yoke arm against the wall at the handle end; and a push rod integrally formed with the leg of said Y-shaped yoke and reciprocally moveable within an aperture in said handle to and from contact with said wall.

2. A razor assembly as claimed in claim 1 wherein said handle has slot means formed within the aperture to engage a tooth means on said push rod to provide a ratchet means whereby the push rod can be held in plurality of fixed positions.

3. A razor as claimed in claim 1 wherein said end wall of said handle has an inwardly facing lip portion thereon to prevent said yoke from sliding out of engagement with said end wall when pushed by said rod.

* * * * *